US008123584B2

(12) United States Patent
Thai

(10) Patent No.: US 8,123,584 B2
(45) Date of Patent: Feb. 28, 2012

(54) BUBBLE GENERATING ASSEMBLY

(75) Inventor: Douglas Thai, Walnut, CA (US)

(73) Assignee: Arko Development Limited, Hong Kong (HK)

( * ) Notice: Subject to any disclaimer, the term of this patent is extended or adjusted under 35 U.S.C. 154(b) by 187 days.

(21) Appl. No.: 11/888,012

(22) Filed: Jul. 31, 2007

(65) Prior Publication Data

US 2007/0270073 A1 Nov. 22, 2007

Related U.S. Application Data

(63) Continuation-in-part of application No. 11/650,529, filed on Jan. 5, 2007, which is a continuation-in-part of application No. 10/655,842, filed on Sep. 5, 2003, now Pat. No. 7,182,665, which is a continuation of application No. 10/247,994, filed on Sep. 20, 2002, now Pat. No. 6,616,498, which is a continuation-in-part of application No. 10/195,816, filed on Jul. 15, 2002, now Pat. No. 6,620,016, which is a continuation-in-part of application No. 10/133,195, filed on Apr. 26, 2002, now Pat. No. 6,659,831, which is a continuation-in-part of application No. 10/099,431, filed on Mar. 15, 2002, now Pat. No. 6,659,834.

(51) Int. Cl.
*A63H 33/28* (2006.01)

(52) U.S. Cl. ..... 446/15; 446/16; 446/17; 446/18; 446/19; 446/20; 446/21

(58) Field of Classification Search ..... 446/15–21
See application file for complete search history.

(56) References Cited

U.S. PATENT DOCUMENTS 185,279 A 12/1876 Baker et al.

(Continued)

FOREIGN PATENT DOCUMENTS

JP 05285278 A * 11/1993

*Primary Examiner* — Gene Kim
*Assistant Examiner* — Alexander Niconovich
(74) *Attorney, Agent, or Firm* — Raymond Sun

(57) ABSTRACT

A bubble generating assembly has a housing shaped as an animal and defining a mouth, with a stationary member secured to a permanent location extending across a portion of the mouth. The assembly includes a reservoir provided inside the housing and retaining bubble solution, a trigger mechanism, a plurality of bubble generating rings positioned adjacent the mouth, a tubing that couples the interior of the reservoir with the ring, and a link assembly that couples the trigger mechanism and the rings in a manner in which actuation of the trigger mechanism causes the rings to be moved from a first position to a second position across the stationary member.

18 Claims, 9 Drawing Sheets

U.S. PATENT DOCUMENTS

| | | | | | |
|---|---|---|---|---|---|
| 430,095 | A | | 6/1890 | Thain | |
| 616,239 | A | | 12/1898 | King | |
| 660,485 | A | | 10/1900 | Bradshaw | |
| 2,041,423 | A | | 5/1936 | Mausolf | |
| 2,213,391 | A | | 9/1940 | Gamble | |
| 2,225,702 | A | | 12/1940 | Lyon, Jr. | |
| 2,393,039 | A | | 1/1946 | Gilchrist, Jr. | |
| 2,396,433 | A | | 3/1946 | Pimblett | |
| 2,398,513 | A | | 4/1946 | Bradley | |
| 2,412,732 | A | | 12/1946 | Holman | |
| 2,527,935 | A | | 10/1950 | Joel, II | |
| 2,547,825 | A | | 4/1951 | King | |
| 2,560,582 | A | | 7/1951 | Limber | |
| 2,587,537 | A | | 2/1952 | Scott | |
| 2,606,396 | A | | 8/1952 | Hill | |
| 2,632,281 | A | | 3/1953 | Schmidt, Jr. | |
| 2,659,177 | A | | 11/1953 | Kopf | |
| 2,700,845 | A | | 2/1955 | Arliss | |
| 2,711,051 | A | | 6/1955 | Pick | |
| 2,736,988 | A | | 3/1956 | Fisher | |
| D185,805 | S | | 8/1959 | Clark | |
| 2,974,438 | A | | 3/1961 | Hopkins | |
| 2,987,847 | A | | 6/1961 | Jones | |
| 3,008,263 | A | | 11/1961 | Ellman | |
| 3,071,888 | A | | 1/1963 | Knott | |
| 3,100,947 | A | | 8/1963 | Hellman | |
| 3,109,255 | A | | 11/1963 | Hein | |
| 3,183,621 | A | | 5/1965 | Allen, Jr. | |
| 3,228,136 | A | * | 1/1966 | Rouse | 446/16 |
| 3,323,250 | A | | 6/1967 | Gibbons | |
| 3,420,412 | A | * | 1/1969 | Greene | 222/78 |
| 3,579,898 | A | | 5/1971 | Hein | |
| 3,601,313 | A | | 8/1971 | Berg | |
| 3,604,144 | A | | 9/1971 | Span | |
| 3,731,412 | A | | 5/1973 | Winslow | |
| 3,736,694 | A | | 6/1973 | Lebensfeld | |
| 3,845,583 | A | | 11/1974 | Ziff | |
| 3,913,260 | A | | 10/1975 | Corbett | |
| 3,925,923 | A | | 12/1975 | La Fata et al. | |
| 3,952,447 | A | | 4/1976 | Hackell | |
| 4,128,962 | A | * | 12/1978 | Anderson | 446/15 |
| 4,246,717 | A | | 1/1981 | Wachtel | |
| 4,299,049 | A | * | 11/1981 | Pimentel et al. | 446/15 |
| D263,062 | S | * | 2/1982 | Rasmussen | D21/402 |
| 4,423,565 | A | | 1/1984 | Bart | |
| 4,438,955 | A | | 3/1984 | Ryan | |
| 4,447,982 | A | | 5/1984 | Gushea | |
| 4,467,552 | A | | 8/1984 | Jernigan | |
| 4,481,731 | A | | 11/1984 | La Fata et al. | |
| 4,603,021 | A | | 7/1986 | Urso | |
| 4,700,965 | A | | 10/1987 | Kinberg | |
| 4,775,348 | A | | 10/1988 | Collins | |
| 4,804,346 | A | * | 2/1989 | Sheng | 446/17 |
| RE32,973 | E | | 7/1989 | Panzarella | |
| D304,466 | S | | 11/1989 | Glickman | |
| 4,957,464 | A | | 9/1990 | Perez | |
| 4,988,319 | A | | 1/1991 | Shen | |
| 4,995,844 | A | * | 2/1991 | McNett et al. | 446/21 |
| 5,035,665 | A | | 7/1991 | Sheng | |
| 5,230,648 | A | | 7/1993 | Kelly et al. | |
| 5,234,129 | A | | 8/1993 | Lau | |
| 5,395,274 | A | | 3/1995 | Myers | |
| 5,462,469 | A | | 10/1995 | Lei | |
| 5,498,191 | A | * | 3/1996 | DeMars | 446/15 |
| 5,520,564 | A | | 5/1996 | DeMars | |
| 5,542,869 | A | | 8/1996 | Petty | |
| 5,613,890 | A | * | 3/1997 | DeMars | 446/15 |
| 5,695,379 | A | | 12/1997 | Ho | |
| 5,832,969 | A | | 11/1998 | Schramm | |
| 5,842,899 | A | * | 12/1998 | Cernansky et al. | 446/16 |
| 5,850,945 | A | | 12/1998 | Frankel | |
| 5,879,218 | A | | 3/1999 | Tao | |
| 6,062,935 | A | | 5/2000 | Gross | |
| 6,102,764 | A | * | 8/2000 | Thai | 446/15 |
| 6,139,391 | A | * | 10/2000 | Thai et al. | 446/15 |
| 6,149,486 | A | * | 11/2000 | Thai | 446/15 |
| 6,200,184 | B1 | * | 3/2001 | Rich et al. | 446/15 |
| 6,231,414 | B1 | * | 5/2001 | Ho | 446/15 |
| 6,315,627 | B1 | | 11/2001 | Thai | |
| 6,331,130 | B1 | * | 12/2001 | Thai | 446/15 |
| 6,416,377 | B1 | | 7/2002 | Bart | |
| 6,544,091 | B1 | | 4/2003 | Thai | |
| 6,547,622 | B2 | | 4/2003 | Thai | |
| 6,616,498 | B1 | * | 9/2003 | Thai | 446/15 |
| 6,620,015 | B2 | * | 9/2003 | Thai | 446/15 |
| 6,620,016 | B1 | | 9/2003 | Thai | |
| 6,659,830 | B2 | | 12/2003 | Thai | |
| 6,682,570 | B2 | * | 1/2004 | Thai | 446/15 |
| 6,893,314 | B2 | | 5/2005 | Thai | |
| 6,988,926 | B2 | | 1/2006 | Thai | |
| 7,056,182 | B2 | * | 6/2006 | Wan | 446/15 |
| 7,470,165 | B2 | * | 12/2008 | Ivanic et al. | 446/15 |
| 2002/0061697 | A1 | | 5/2002 | Hornsby et al. | |
| 2002/0094744 | A1 | * | 7/2002 | Cheng | 446/15 |

* cited by examiner

BUBBLE GENERATING ASSEMBLY

RELATED CASES

This is a continuation-in-part of co-pending Ser. No. 11/650,529, filed Jan. 5, 2007, which is a continuation-in-part of Ser. No. 10/655,842, filed Sep. 5, 2003, now U.S. Pat. No. 7,182,665, which is a continuation of Ser. No. 10/247,994, filed Sep. 20, 2002, now U.S. Pat. No. 6,616,498, which is a continuation-in-part of Ser. No. 10/195,816, filed Jul. 15, 2002, now U.S. Pat. No. 6,620,016, which is in turn a continuation-in-part of Ser. No. 10/133,195, filed Apr. 26, 2002, now U.S. Pat. No. 6,659,831, which is in turn a continuation-in-part of Ser. No. 10/099,431, filed Mar. 15, 2002, now U.S. Pat. No. 6,659,834, whose disclosures are incorporated by this reference as though fully set forth herein.

BACKGROUND OF THE INVENTION

1. Field of the Invention

The present invention relates to bubble toys, and in particular, to a bubble generating assembly which automatically forms a bubble film over a bubble ring without the need to dip the bubble ring into a container or a dish of bubble solution.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. No. 6,149,486 (Thai), U.S. Pat. No. 6,331,130 (Thai) and U.S. Pat. No. 6,200,184 (Rich et al.). The bubble rings in the bubble generating assemblies in U.S. Pat. No. 6,149,486 (Thai), U.S. Pat. No. 6,331,130 (Thai) and U.S. Pat. No. 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

Thus, there remains a need to provide an apparatus and method for forming a film of bubble solution across a bubble ring without the need to dip the bubble ring into a dish of bubble solution.

SUMMARY OF THE DISCLOSURE

It is an object of the present invention to provide an apparatus and method for effectively forming a film of bubble solution across a bubble ring.

It is another object of the present invention to provide an apparatus and method for effectively forming a film of bubble solution across a bubble ring in a manner which minimizes spillage of the bubble solution.

The objectives of the present invention are accomplished by providing a bubble generating assembly that has a housing shaped as an animal and defining a mouth, with a stationary element secured to a permanent location extending across a portion of the mouth. The assembly includes a reservoir provided inside the housing and retaining bubble solution, a trigger mechanism, a plurality of bubble generating rings positioned adjacent the mouth, a tubing that couples the interior of the reservoir with the rings, and a link assembly that couples the trigger mechanism and the rings in a manner in which actuation of the trigger mechanism causes the rings to be moved from a first position to a second position across the stationary element.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 2:
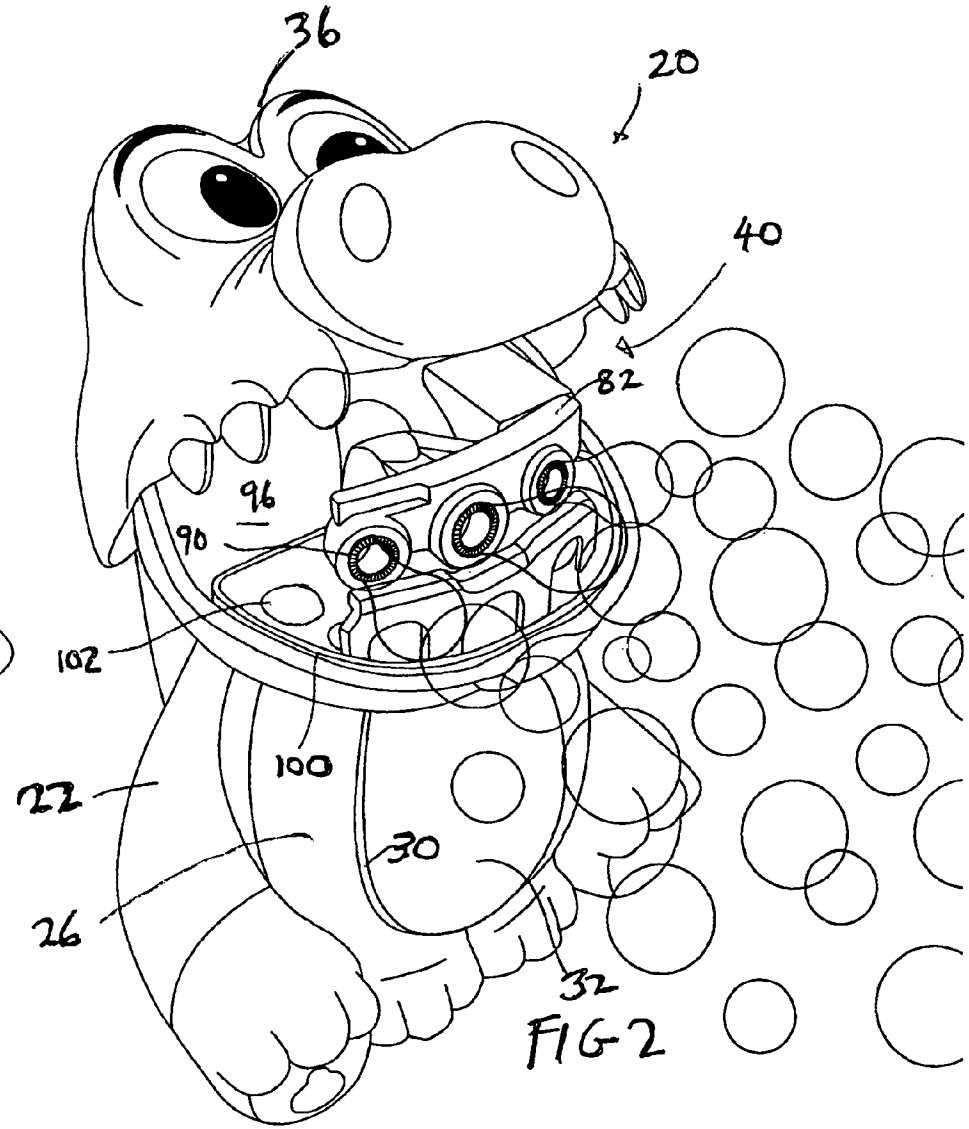
FIG. 2 is a perspective view of the assembly of FIG. 1 shown with the mouth open.
Figure 1:
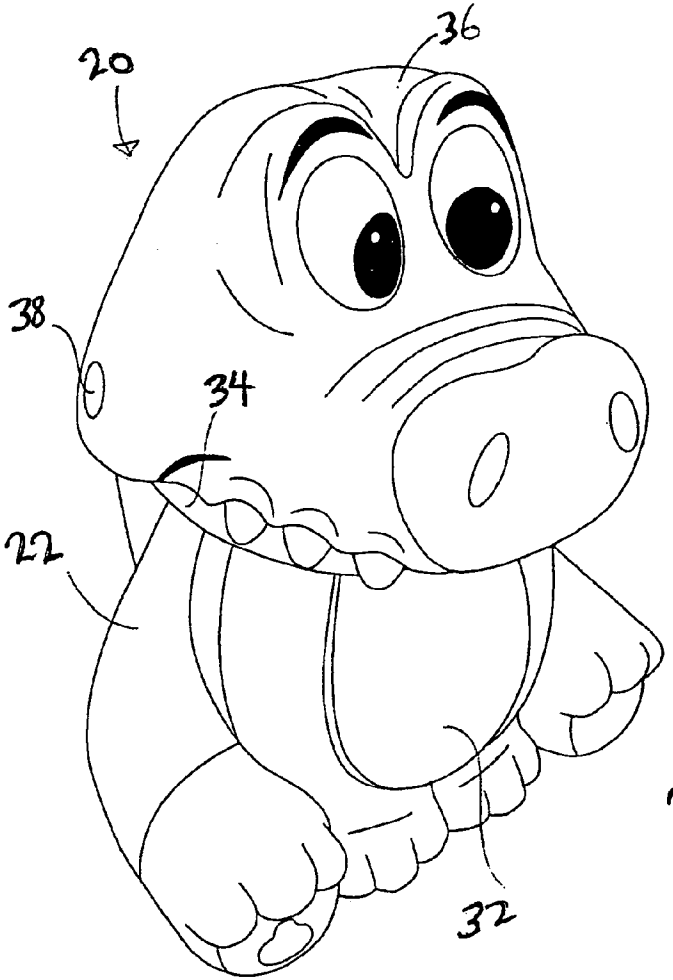
FIG. 1 is a perspective view of an animal-shaped bubble generating assembly according to one embodiment of the present invention shown with the mouth closed.

FIGS. 1-11 illustrate one embodiment of a bubble generating assembly 20 according to the present invention. The assembly 20 has a housing 22 that is shaped like an animal. For example, the housing 22 in FIGS. 1-2 is shaped like a crocodile. The housing 22 can also shaped like any of the following animals: a pony, a dog, a horse, a lion, a tiger, a bear, a giraffe, an elephant, a hippopotamus, an alligator, a rabbit and a cat. The housing 22 includes a handle section 24 and a body section 26. The handle section 24 can be the tail of the animal. The housing 22 can be provided in the form of two symmetrical outer shells that are connected together by, for example, screws or welding or glue. These outer shells together define a hollow interior for housing the internal components of the assembly 20, as described below. The handle section 24 has an opening 28 (see FIG. 3A) through which a user can extend his or her fingers to grip the handle section 24 and to press (i.e., actuate) a trigger 45. The body section 26 has an opening 30 which defines a window for receiving a portion of a reservoir 32. The reservoir 32 is adapted to hold bubble solution, and can be made of a transparent material (e.g., plastic) so that the user can see the fill-level of the bubble solution in the reservoir 32 via the window or opening 30.

The upper part of the body section 26 has a jaw section 34 that forms the lower jaw of the animal. A head section 36 is pivotally connected to the jaw section 34 via a hinged screw 38 at the rear of the sections 34, 36, with a bubble generating space 40 defined between the head section 36 and the jaw section 34. The jaw section 34 and the head section 36 are together configured to resemble the head of the desired animal, and can include eyes and ears. However, the mouth of the animal is defined by the space created when the head section 36 is pivoted upwardly from the jaw section 34 (which is stationary). FIG. 1 illustrates the mouth closed, with the head section 36 seated on top of the jaw section 34, while FIG. 2 illustrates the mouth opened with the head section 36 pivoted upwardly from the jaw section 34.

Figure 7:
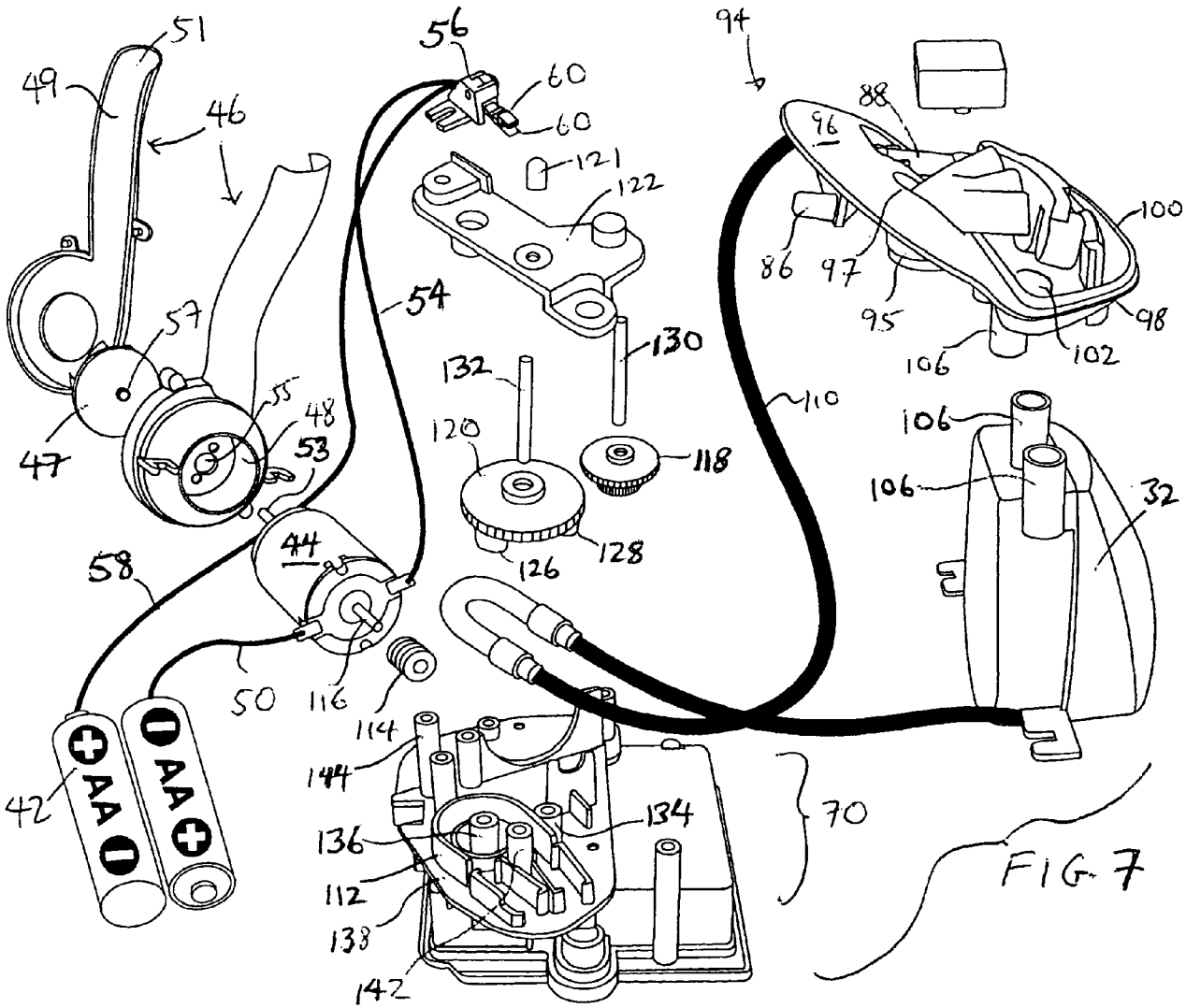
FIG. 7 is an exploded perspective view of the actuation system of the assembly of FIG. 1.
Figure 8:
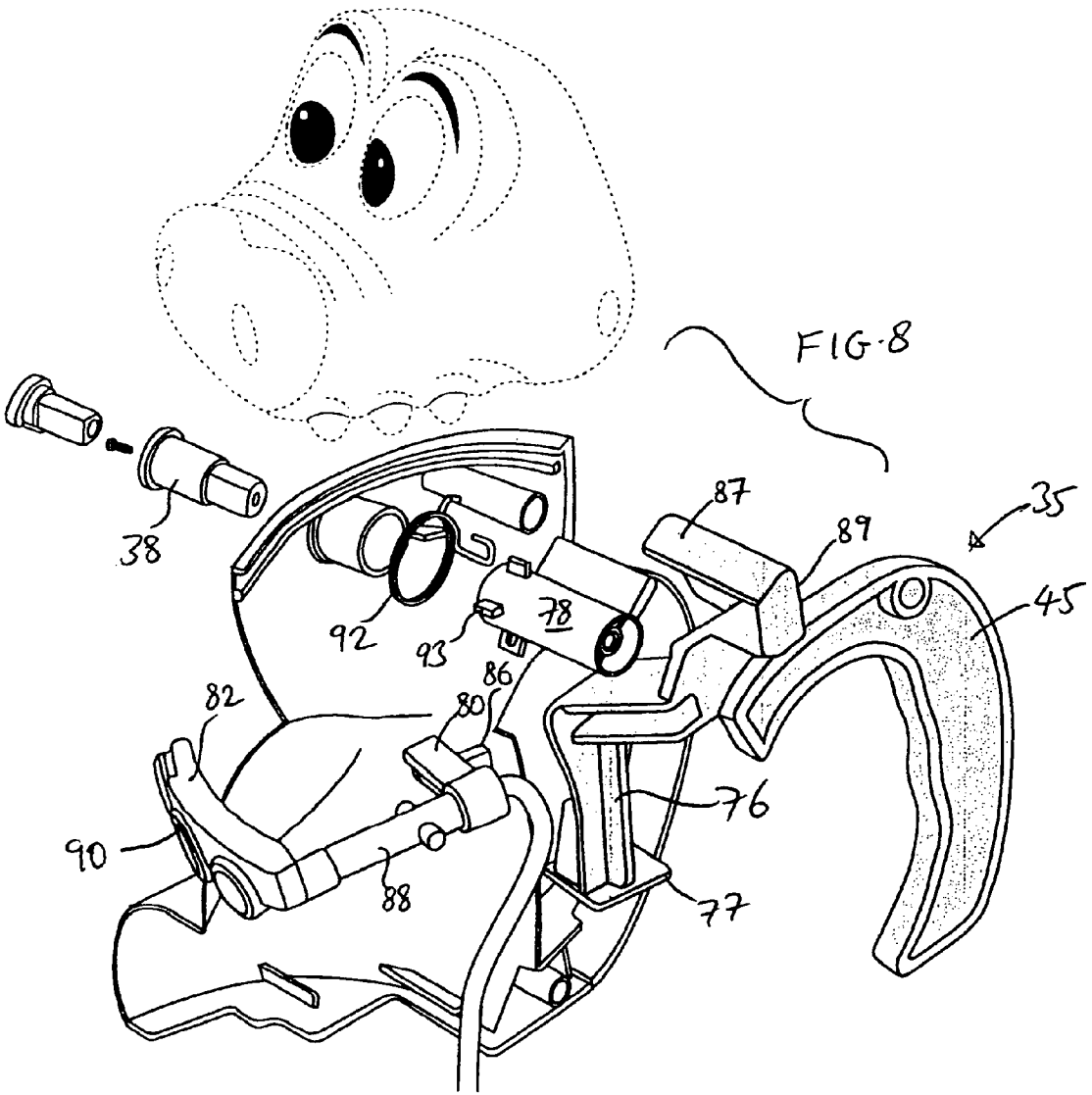
FIG. 8 is an exploded view illustrating some of the components of the assembly of FIG. 1.

Referring to FIG. 7, the body section 26 houses a power source 42 which can include at least one conventional battery. A motor 44 is electrically coupled to the power source 42 via a first wire 50. A second wire 54 couples the motor 44 to a switch 56. A third wire 58 couples the switch 56 to the power source 42. The switch 56 is coupled to a gear housing plate 122 (described below, see FIGS. 10A and 11A), and has a pair of spaced-apart plates 60 are adapted to releasably contact each other to form a closed electrical circuit. The motor 44 is received in a receiving space 48 of a fan housing 46. The fan housing 46 can include two separate housing shells that are attached together to define an internal space that houses a fan blade 47. The upper portion of the fan housing 46 also defines a curved air channel 49 that leads to an opening 51 at the top. The motor 44 has a shaft 53 that extends through an opening 55 in the fan housing 46 to be coupled to a bore 57 in the fan blade 47. A pump system 70 (described in greater detail below) is operatively coupled to the motor 44 and an actuator 35 (see FIG. 9).

Figures 9, 12:
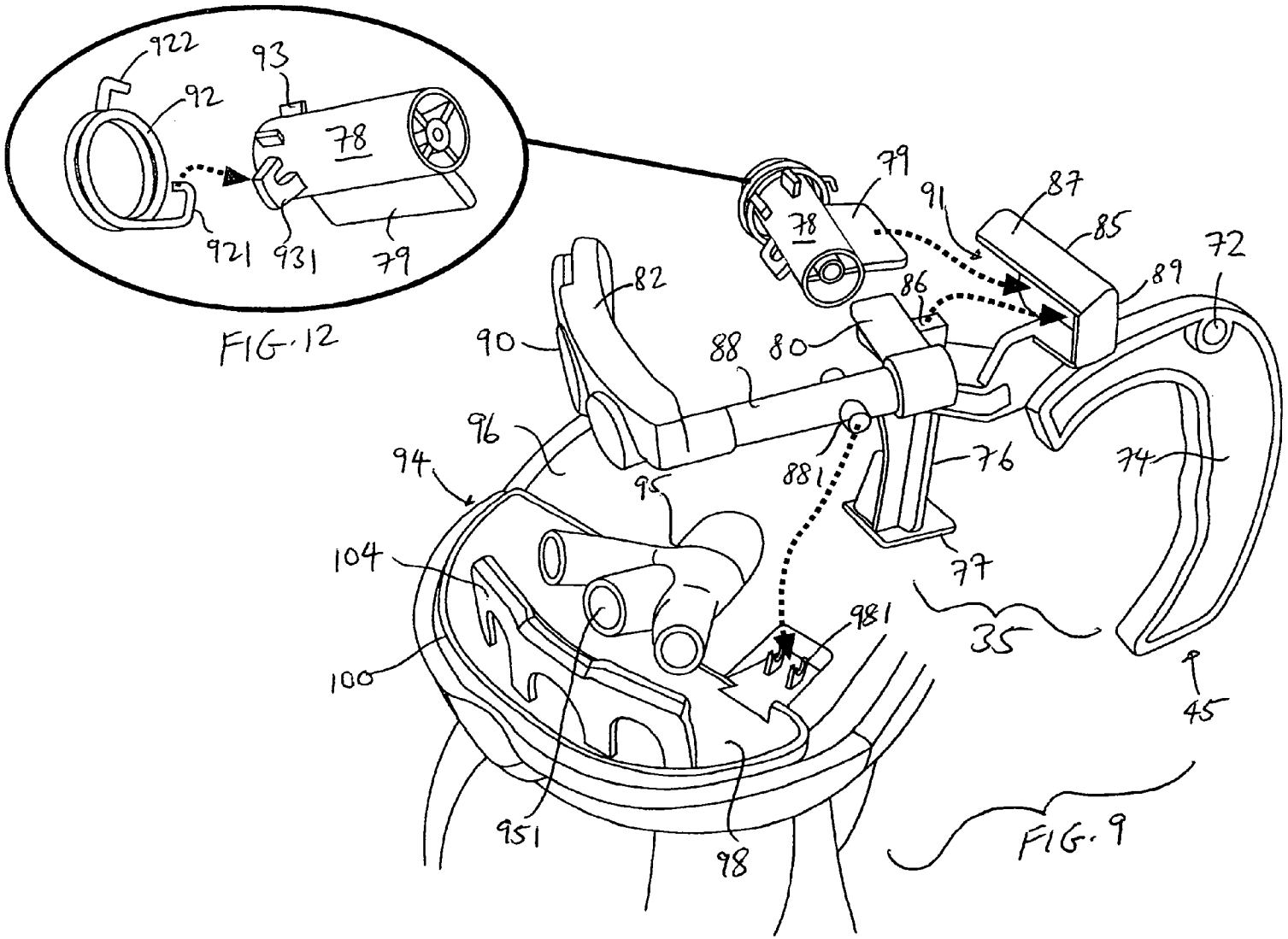
FIG. 9 is an exploded perspective view of the actuator and other internal components of the assembly of FIG. 1.
FIG. 12 is an exploded enlarged view showing the spring and the pivot member from FIG. 9.

Referring also to FIG. 9, the actuator 35 includes the trigger 45, a hooked extension 85 and a pump pusher 76, which can either be provided in one piece, or in separate pieces and then connected together. The L-shaped pump pusher 76 extends downwardly to releasably contact the pump system 70, as shown in FIGS. 10 and 11. The pump pusher 76 has a planar bottom piece 77. The trigger 45 has a generally L-shaped trigger piece 74 that is pivotally connected to the handle section 24 via a pivot pin 72. The trigger 45 is normally positioned in a normal, non-actuated, position shown in FIGS. 3A and 5, but when the user presses the trigger 45, the trigger 45 is pushed to the actuated position shown in FIGS. 4A and 6.

Referring also to FIGS. 3-6 and 8-9, a tubular pivot member 78 is pivotally connected to the jaw section 34 via the hinged screw 38. The pivot member 78 has a rear flange 79. The hooked extension 85 extends upwardly from the top of the trigger piece 74, and has an upper wall 87 and a rear wall 89 that together define a space 91. The flange 79 of the pivot member 78 is positioned in the space 91, with the upper wall adapted to engage or push the flange 79. An extension 86 of a tubular link 88 is also adapted to be positioned in the space 91, with the upper wall also adapted to engage or push the extension 86. The extension 86 is attached to the rear end of the link 88 via a leg 80, and a bar 82 is attached to the front end of the link 88 in a manner that is generally perpendicular to the link 88. The bar 82 can be slightly arcuate, with a plurality of bubble openings or rings 90 provided in the bar 82. In the present embodiment, three rings 90 are provided. A pivot shaft 881 is provided along the length of the link 88 at a location closer to the rear of the link 88 so that the front end of the link 88 (which carries the bar 82) is heavier. The pivot shaft 881 is adapted to be pivotably fitted inside a pair of grooved extensions 981 provided on a platform 94 (that is described in greater detail below). In addition, one end of the leg 80 is positioned adjacent the flange 79, but does not engage the flange 79.

A plurality of ribs 93 are provided in a spaced apart manner about the circumference at an end of the tubular pivot member 78, and the ribs 93 are adapted to retain a resilient member, such as a coiled spring 92. One end 921 of the spring 92 is coupled to a hooked rib 931 on the pivot member 78, and the other end 922 of the spring 92 is coupled to a portion of the housing 22 (see FIG. 4A). The spring 92 normally biases the pivot member 78 upwardly in a counterclockwise direction. As used hereinafter, all references to the clockwise or counterclockwise directions are with respect to the orientation of FIGS. 3A, 4A, 8 and 9.

When a user presses the trigger 45, the pressing force overcomes the natural bias of the spring 92 and pushes the trigger 45 in the rearward direction (see arrow A1 in FIG. 4A), which simultaneously causes (i) the pump pusher 76 to move downwardly to push both the knob 121 and the contacts 60, (ii) the head section 36 to be pivoted upwardly, and (iv) the bar 82 and its rings 90 to be raised. In particular, rearward movement of the trigger 45 pivots the entire actuator 35 counterclockwise about the pivot point 72, so that the upper wall 87 of the hooked extension 85 contacts and pushes the flange 79 and the extension 86 downwardly. Downward motion of the flange 79 causes the pivot member 78 to pivot in a clockwise direction, which causes the head section 36 to be pivoted upwardly because the hinged screw 38 secures the head section 36 to the pivot member 78. Downward motion of the extension 86 causes the link 88 to pivot about the pivot shaft 881 in a clockwise direction, which causes the bar 82 and its rings 90 be raised. In addition, when the pump pusher 76 presses against the contacts 60, it causes the contacts 60 to engage, closing the electrical circuit and actuating the motor 44.

When the user releases his or her grip on the trigger 45, the natural bias of the spring 92 will bias the pivot member 78 to pivot in a counterclockwise direction, which simultaneously causes (i) the head section 36 to be pivoted downwardly, (ii) the pump pusher 76 to be raised, and (iv) the bar 82 and its rings 90 to be raised. In particular, pivoting of the pivot member 78 in a counterclockwise direction causes the flange 79 to pivot upwardly in a counterclockwise direction, which pushes the upper wall 87 in an upward direction (see FIG. 3A). Upward movement of the upper wall 87 causes the entire actuator 35 to be pivoted about the pivot point 72 in a clockwise direction, thereby causing the pump pusher 76 to be raised and the trigger 45 to be moved back into the space 28 in the direction of arrow A2 (see FIG. 3A). Upward movement of the upper wall 87 releases its engagement on the extension 86, and the greater weight of the front end of the link 88 will cause the link 88 to be pivoted about the pivot shaft 881 in the same upward counterclockwise direction, which in turn causes the bar 82 (and its rings 90) to be lowered. When the pump pusher 76 is raised, the downward pressure against the knob 121 and the contacts 60 is released, causing the contacts 60 to disengage (because of the resilient nature of the contacts 60), thereby opening the electrical circuit so that the motor 44 is not powered by the power source 42 under normal (non-operation) circumstances.

Figure 5:
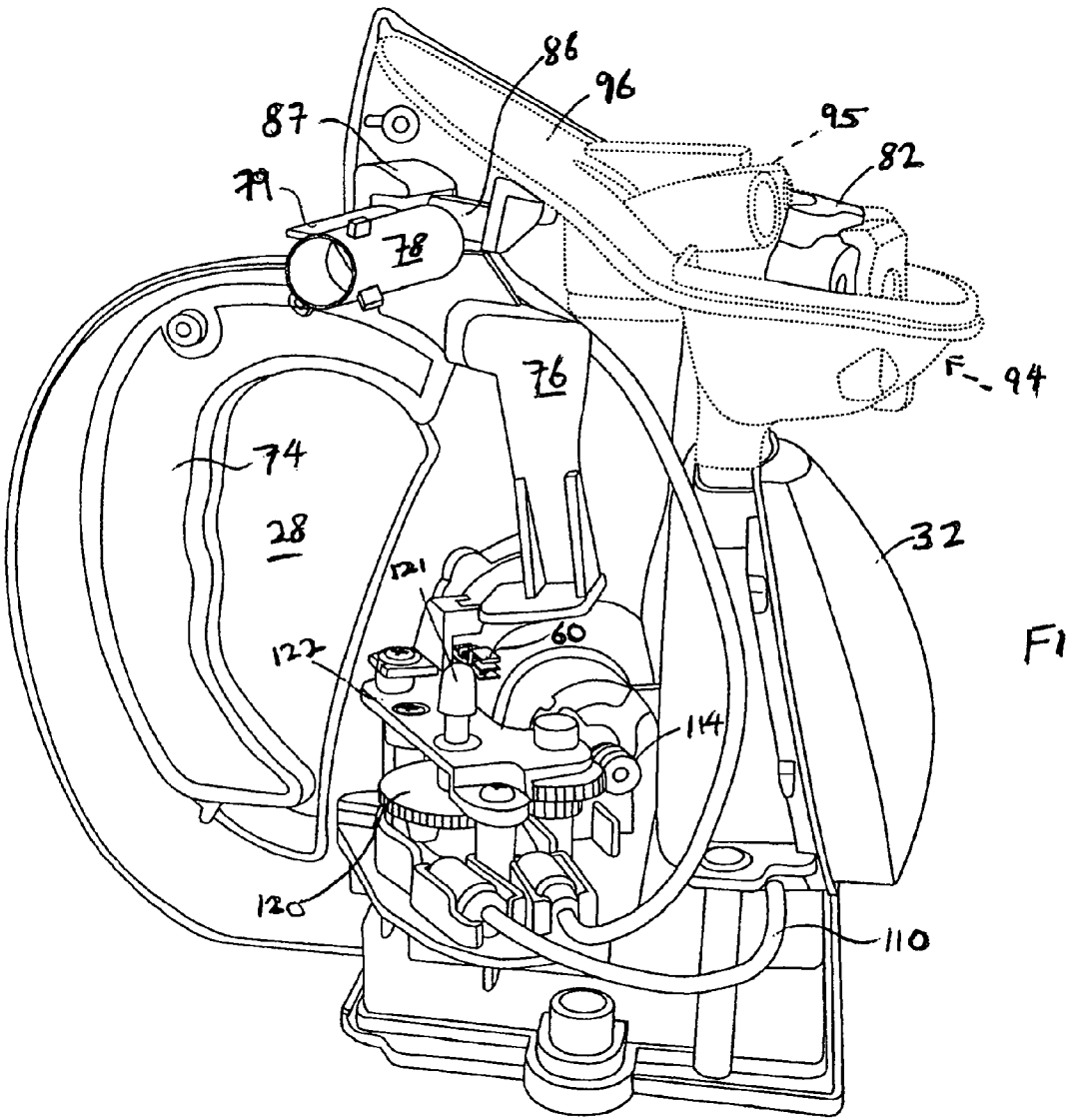
FIG. 5 is a perspective view of the internal components of the assembly of FIG. 1 shown with the trigger in the normal position.
Figure 6:
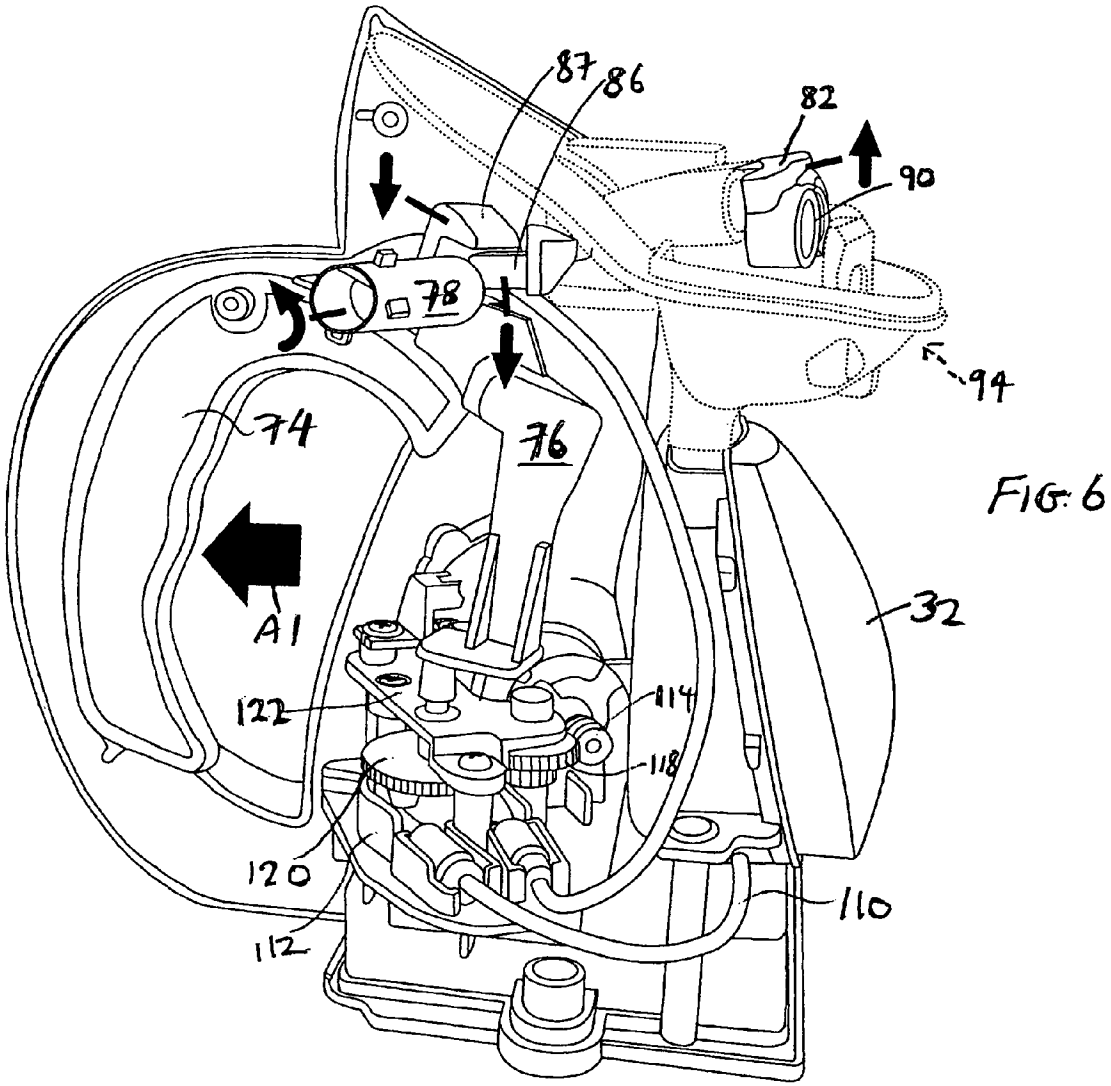
FIG. 6 is a perspective view of the internal components of the assembly of FIG. 1 shown with the trigger being actuated.

As best seen in FIGS. 2, 7 and 9, the link 88 is supported on a platform 94 that has a sloped portion 96 and a receiving portion 98. The platform 94 and receiving portion 98 are positioned in the space 40. Referring also to FIGS. 5 and 6 (where the platform 94 is shown in phantom), the link 88 extends through an opening in the sloped portion 96, and the curved upper portion of the fan housing 46 is connected to a multi-passage spout 95 that extends through another opening 97 in the sloped portion 96. The spout 95 has a plurality of branches, each terminating at an opening 951. The number of openings 951 correspond to the number of rings 90, with each opening 951 adapted to be positioned adjacent a corresponding ring 90 when the bar 82 is in the raised position shown in FIG. 4B. The receiving portion 98 has a curved wall 100 extending along the front edge of the jaw section 34. The curved wall 100 surrounds a plurality of openings 102 that lead to a plurality of tubes 106 in the platform 94. A stationary wiping member 104 extends vertically from about the center of the receiving portion 98. The bar 82 is normally positioned directly behind the wiping member 104, with the wiping member 104 and the rings 90 on the bar 82 oriented in a manner so that the rings 90 brush against the rear surface of the wiping member 104 when the bar 82 is pivoted upwardly or downwardly. As a result, the wiping member 104 is slightly curved to correspond to the shape of the bar 82. The wall 100 functions to define a collection space that can collect and receive droplets of bubble solution that have dripped from the bubble rings 90, and deliver these droplets of bubble solution back into the interior of the reservoir 32 via the openings 102 and tubes 106.

A plurality of tubes 106 extend downwardly from the opening in the platform 94 surrounded by the raised wall 100. The tubes 106 extend through and into the body section 26, and terminates at the reservoir 32. Thus, a user can add bubble solution to the reservoir 32 by pouring bubble solution into the space defined by the curved wall 100, and the bubble solution will flow through the tubes 106 into the reservoir 32. The user can check on the level of the bubble solution by viewing the window 30.

The construction of each bubble ring 90 in the bar 82 can be the same as that illustrated in FIG. 15 of U.S. Pat. No. 6,616,498. The ring 90 has an annular base piece that has a cylindrical wall extending therein to define an annular chamber therein. An opening is provided in the base piece. The ring 90 also has an annular cover piece that fits into the annular chamber of the base piece. A plurality of outlets can be provided along the inner annular surface, and/or the front surface, of the cover piece. The front end of the link 88 is attached to the bar 82, and the bar 82 configured so that the hollow bore of the bar 82 is aligned with an opening in the annular base piece. A tubing 110 (see FIG. 7) extends through the hollow bore of the link 88 to deliver bubble solution from the reservoir 32 via the tubing 110 into hollow bore of the bar 82, and then into the chamber of each ring 90. The bubble solution from the chamber can then leak out of the outlets onto the front surface of the ring 90.

Referring now to FIGS. 5-7 and 10A-11B, the assembly 20 includes a pump system that functions to pump the bubble solution from the reservoir 32 to the bubble rings 90. The pump system includes the motor 44, the tubing 110, a guide wall 112, and a gear system that functions to draw bubble solution through the tubing 110. The gear system includes a motor gear 114 that is rotatably coupled to a shaft 116 of the motor 44, a first gear 118, a second gear 120, a gear housing plate 122, a resilient element 124 (such as a spring, see FIGS. 10B and 11B), and two pressure rollers 126 and 128 that are secured to the bottom surface of the second gear 120. Gear shafts 130 and 132 extend from the gear housing plate 122 through bores in the gears 118 and 120, respectively, and into receiving bores 134 and 136, respectively, provided on a base plate 138, to rotatably connect the gears 118 and 120 to the plates 122 and 138. Connecting shafts (not shown) extend from the gear housing plate 122 into receiving bores 142 and 144 provided on a base plate 138 to secure the gear housing plate 122 to the base plate 138.

The motor gear 114 has teeth that are engaged with the teeth of the first gear 118. See FIGS. 5 and 6. The first gear 118 has teeth that are engaged with the teeth of the second gear 120. Referring also to FIGS. 10 and 11, the second gear 120 rotates about an axis defined by the shaft 132, and the resilient element 124 is carried on the shaft 132 between the second gear 120 and a raised support 146 extending from the base plate 138. The pressure rollers 126, 128 are spaced apart along the outer periphery of the second gear 120. Each pressure roller 126,128 has a truncated cone configuration which has a largest diameter at a base section where the roller 126, 128 is connected to the second gear 120, with the diameter decreasing to a smallest diameter at an end at its furthest distance from the second gear 120. The tubing 110 is received inside the guide wall 112 with portions of the tubing 110 lying on opposite sides of the raised support 146.

Figures 10A, 10B, 11A, 11B:
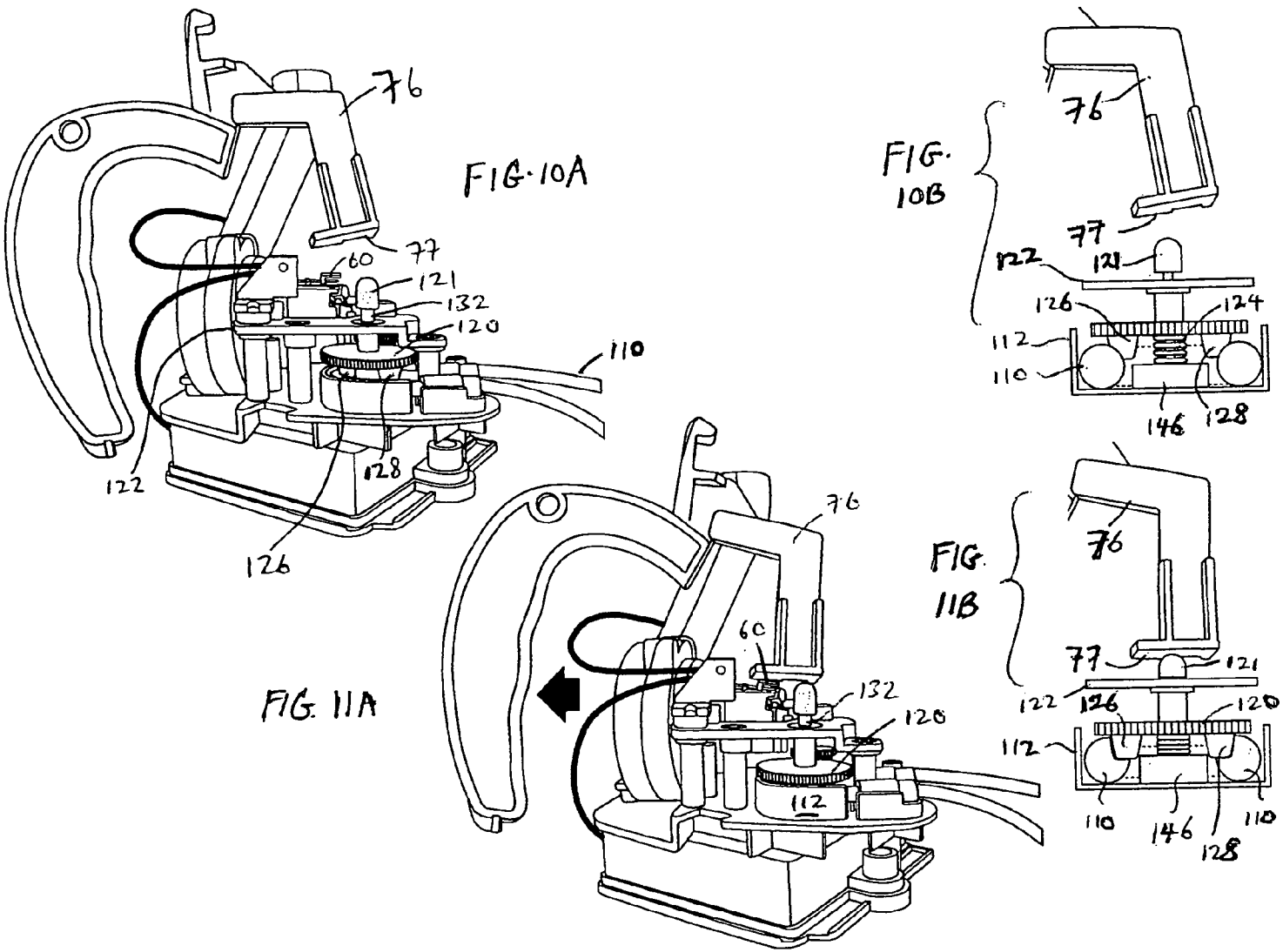
FIGS. 10A, 10B, 11A and 11B illustrate how the pump pusher actuates the pump of the assembly of FIG. 1.

The pump system operates in the following manner. When the trigger 45 is pressed in the direction of the arrow Al, the pump pusher 76 will move downwardly and (i) press the knob 121 of the plate 122 downwardly (compare FIGS. 10A and 11A, FIGS. 10B and 11B, and FIGS. 5 and 6), and (ii) press the contacts 60 to close of the electrical circuit to cause the motor 44 to be actuated. When the plate 122 is pressed down, the rollers 126, 128 will compress the tubing 110, as best shown in FIG. 11. When the motor 44 is actuated, the motor gear 114 will rotate, thereby causing the first and second gears 118 and 120 to rotate as well. As the second gear 120 rotates, the rollers 126, 128 will also rotate because they are carried by the second gear 120. As the rollers 126, 128 rotate, they will apply selected pressure on different parts of the tubing 110 in the manner described below to draw bubble solution from the reservoir 32 to the bubble ring 90. At the same time, actuation of the motor 44 will rotate the fan blade 47 to cause air to be generated and expelled from the opening 51.

The assembly 20 operates in the following manner. In the normal (non-operational) position, which is illustrated in FIGS. 1, 3B, 5 and 10A, the bar 82 and its ring 90 are positioned behind the wiping member 104 inside the platform 94. In this normal position, the spring 92 normally biases the pivot member 78 in the counterclockwise direction, and normally biases the trigger 45 into the opening 28 in the direction of the arrow A2.

The assembly 20 is actuated merely by pressing the trigger 45 in the direction of the arrow Al to overcome the natural bias of the resilient member 92, which causes four sequences of events occur at about the same time.

First, rearward motion of the trigger 45 simultaneously causes (i) the upper wall 87 of the hooked extension 85 to push the flange 79 downwardly (i.e., in a clockwise direction), (ii) the upper wall 87 to push the extension 86 of the link 88 downwardly (i.e., in a clockwise direction), and (iii) the pump pusher 76 to move downwardly.

Second, bubble solution is pumped to the bubble rings 90. In this regard, the downward movement of the pump pusher 76 causes the contacts 60 to engage, thereby forming a closed electrical circuit that will deliver power from the power source 42 to the motor 44. The motor 44 will turn on, thereby causing the motor gear 114 to drive and rotate the first and second gears 118 and 120. As the rollers 126, 128 on the second gear 120 rotate, they will apply selected pressure on different parts of the tubing 110. FIGS. 10A, 10B, 11A and 11B illustrate this in greater detail. FIGS. 10A and 10B illustrate the relationship between the pressure rollers 126, 128 and the tubing 110 when the assembly 20 is in the normal non-operational condition, and FIGS. 11A and 11B illustrate the relationship between the pressure rollers 126, 128 and the tubing 110 when the assembly 20 is in the actuated (i.e., bubble-generating) position. As shown in FIGS. 10A and 10B, the tubing 110 is normally fitted between the guide wall 112 and the raised support 146, with the smaller-diameter end of the pressure rollers 126, 128 barely impinging on the tubing 110. The resilient element 124 normally biases the second gear 120 upwardly away from the tubing 110. When the trigger 45 is pressed, the pump pusher 76 moves downwardly, overcoming the normal bias of the resilient element 124 and causing the second gear 120 and its rollers 126,128 to be pushed into the tubing 110 so that the tubing 110 is now positioned between the guide wall 112 and the larger-diameter portions of the pressure rollers 126, 128, thereby compressing the tubing 110 as shown in FIG. 11. Thus, rotation of the pressure rollers 126, 128 will compress different portions of the tubing 110, thereby creating air pressure to draw the bubble solution from the interior of the reservoir 32 through the tubing 110 into the chamber of the bubble rings 90, where the bubble solution will bleed out through the outlets on to the front surface of the bubble rings 90.

This arrangement and structure of the pressure rollers 126, 128 is effective in prolonging the useful life of the tubing 110 and the pump system. In particular, the rollers 126, 128 only apply pressure against the tubing 110 when the trigger 45 is pressed (i.e., the larger-diameter portion of the rollers only compresses the tubing 110 when the trigger 45 is pressed), so that the tubing 110 only experiences minimal pressure when the trigger 45 is not pressed (i.e., the smaller-diameter end of the rollers 126, 128 is positioned adjacent to, but does not compress, the tubing 110 when the trigger 45 is not pressed). This is to be contrasted with conventional pump systems used for pumping bubble solution to a bubble producing device, where pressure is always applied to the tubing regardless of whether the trigger is actuated. Over a long period of time, this constant pressure will deform the tubing, making it difficult for bubble solution to be drawn through the tubing.

Figure 3A:
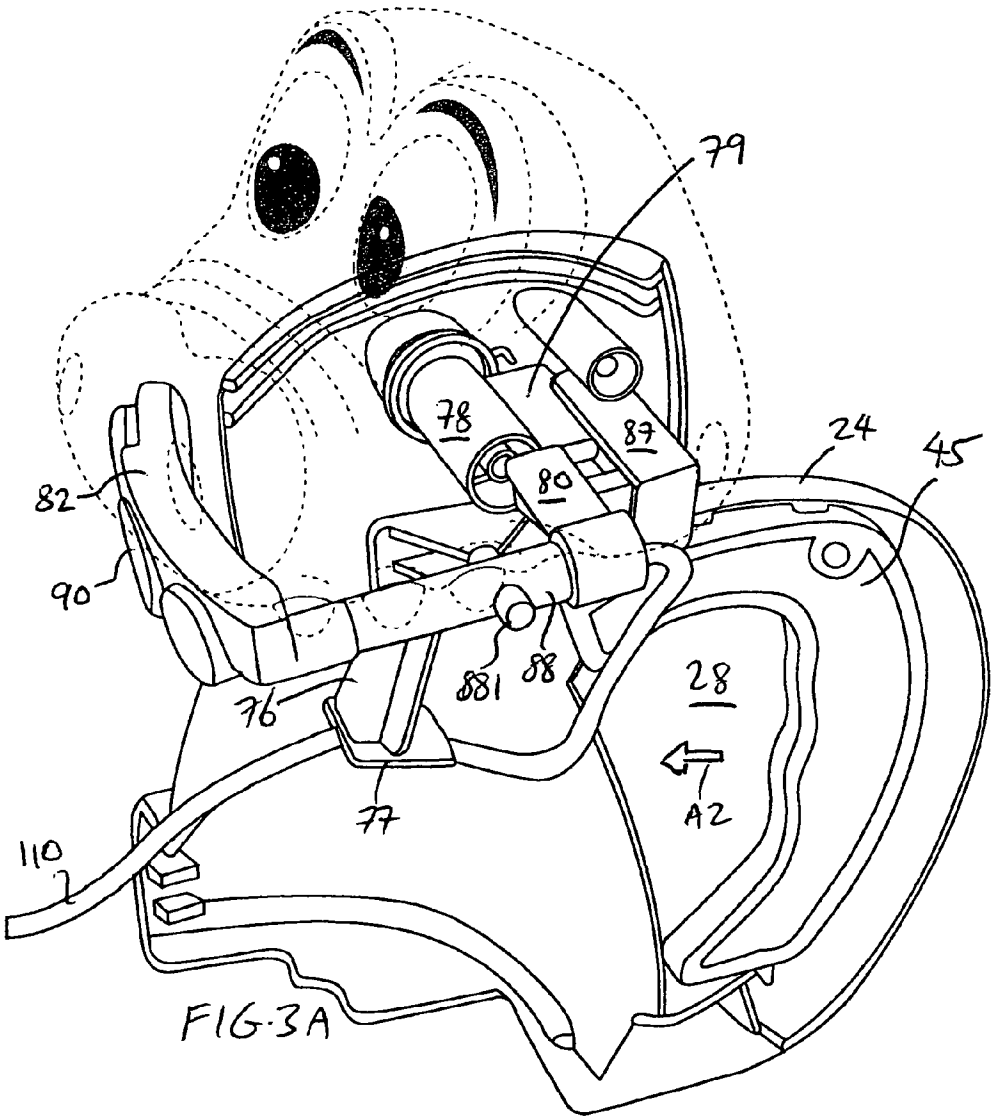
FIG. 3A is a perspective view of some of the internal components of the assembly of FIG. 1 shown with the trigger in the normal position.
Figure 3B:
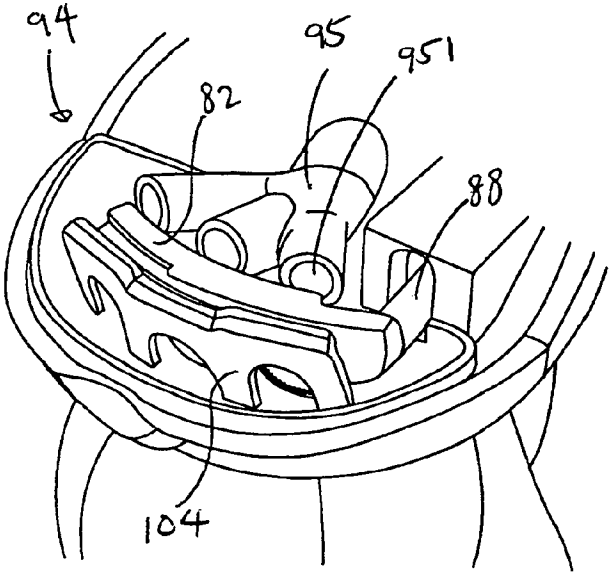
FIG. 3B is an enlarged view of the bubble generating devices for the assembly in the position shown in FIG. 3A.
Figure 4A:
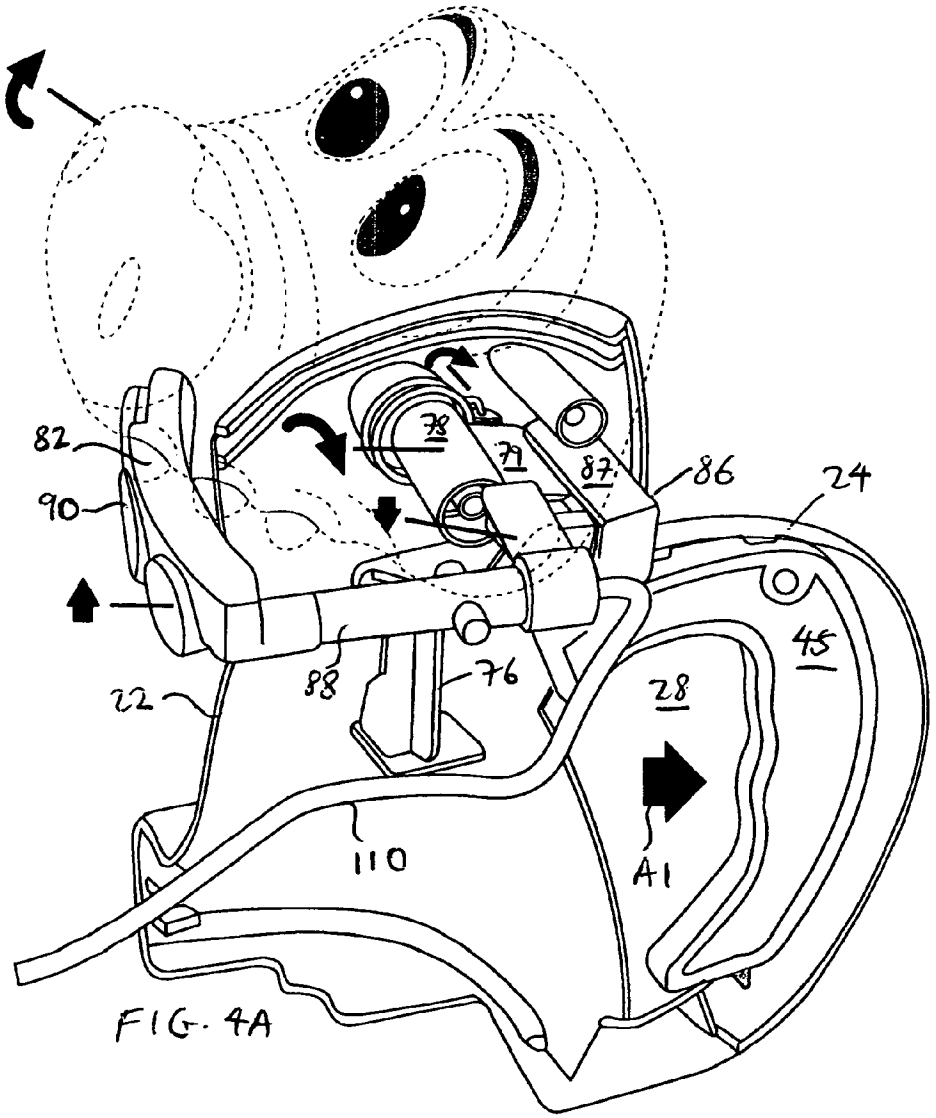
FIG. 4A is a perspective view of some of the internal components of the assembly of FIG. 1 shown with the trigger being actuated.
Figure 4B:
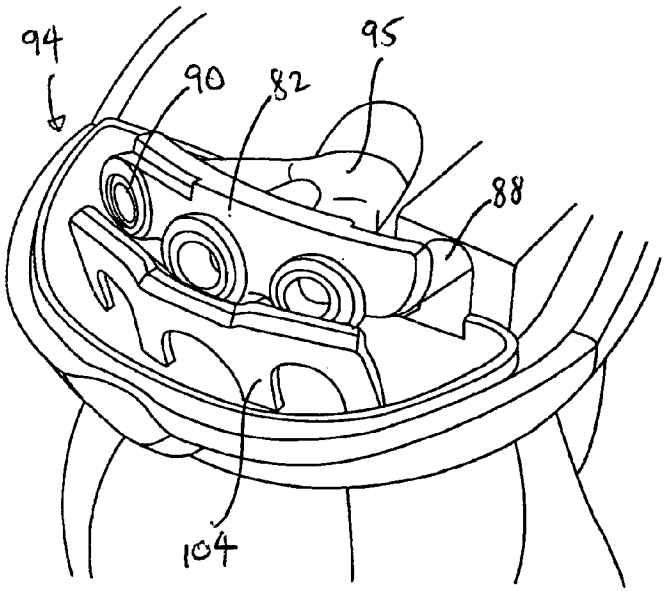
FIG. 4B is an enlarged view of the bubble generating devices for the assembly in the position shown in FIG. 4A.

Third, the bar 82 and its bubble ring 90 will be moved from the position shown in FIG. 3B to a position at about the center of the platform 94, as shown in FIG. 4B, in the manner described above. As the upper wall 87 pushes the extension 86 of the link 88 downwardly, the link 88 pivots in the clockwise direction about the pivot shaft 881, causing the bar 82 to be raised. As the bar 82 is raised, the rings 90 will travel in an upward curved path as the front surface of the rings 90 wipe across the stationary wiping member 104. At this point, each ring 90 will be positioned adjacent an opening 951 of the spout 95. The wiping motion of the wiping member 104 along the front surface of the rings 90 will generate a film of bubble solution (from the bubble droplets emitted from the outlets) that extends across the opening of each ring 90.

Fourth, the fan blade 47 that is secured to the motor 44 is actuated when the motor 44 is turned on. In this regard, the downward movement of the pump pusher 76 causes the electrical contacts 60 to engage, thereby forming a closed electrical circuit that will deliver power from the power source 42 to the motor 44 to rotate the fan blade 47. The fan blade 47 blows a stream of air along the air channel 49 and out of the opening 51, through the spout 95 and out of its openings 951 towards the rings 90. This stream of air will then travel through the film of bubble solution that has been formed over each bubble ring 90, thereby creating bubbles.

Thus, pressing the trigger 45 will create a film of bubble solution across the bubble rings 90 by (i) pumping bubble solution from the reservoir 32 to the bubble ring 90, and (ii) and causing the bubble rings 90 to be moved across the wiping member 104 to the openings 951 so that bubbles can be created. Pressing the trigger 45 will also actuate the fan blade 47 to blow streams of air at the bubble rings 90 to create a plurality of bubbles.

When the user releases his or her pressing grip on the trigger 45, the spring 92 will normally bias the trigger 45 back in the direction A2 into the opening 28, causing three events to occur.

First, the pump system will stop drawing bubble solution from the reservoir 32 to the bubble rings 90. This occurs because power to the motor 44 has been cut so that the gears 114, 118 and 120 stop rotating, and because the movement of the trigger 45 in the direction A2 into the opening 28 will raise the pump pusher 76 from its downward pressure on the plate 122, so that the normal bias of the resilient member 124 will push the second gear 120 and its rollers 126, 128 upwardly away from the tubing 110, so that the tubing 110 will again be positioned between the guide wall 112 and the smaller-diameter end of the rollers 126, 128, thereby releasing the pressure applied by the rollers 126, 128 on the tubing 110 as shown in FIGS. 10A and 10B. The movement of the trigger 45 in the direction A2 is caused by the bias of the spring 92 pivoting the flange 79 counterclockwise to push or pivot the upper wall 87 (and the entire actuator 35) in a clockwise direction.

In the second event, the raising of the pump pusher 76 causes the electrical contacts 60 to disengage so that the electrical circuit is opened, thereby cutting power to the motor 44. As a result, the fan blade 47 will stop producing streams of air.

In the third event, upward movement of the upper wall 87 releases its engagement on the extension 86, and the greater weight of the front end of the link 88 will cause the link 88 to be pivoted about the pivot shaft 881 in a counterclockwise direction to cause the bar 82 and its rings 90 to travel in a downward curved path as the front surface of the rings 90 wipes across the stationary wiping member 104, back to the normal (non-operation) position shown in FIGS. 1, 3B and 5.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly comprising:

a housing shaped as an animal and defining a mouth, with a curved stationary member secured to a permanent location extending across a portion of the mouth;

a reservoir provided inside the housing and retaining bubble solution, the reservoir having an interior;

a trigger mechanism;

a plurality of bubble generating rings positioned adjacent the mouth, the plurality of bubble generating rings arranged on a curved bar;

a tubing that couples the interior of the reservoir with the rings; and a link assembly that couples the trigger mechanism and the curved bar in a manner in which actuation of the trigger mechanism causes the curved bar to be moved from a first position to a second position across the stationary member; wherein the curved bar and the curved stationary member curve along a common axis wherein the common axis extends vertically from the bottom of the housing to the top of the housing so that the central portion of the curved bar and the central portion of the curved stationary member extend further along a common plane in a direction from the rear of the housing to the front of the housing than the ends of the curved bar and the ends of the curved stationary member extend along said common plane in said direction from the rear of the housing to the front of the housing wherein said common plane extends horizontally from the rear of the housing to the front of the housing.

2. The assembly of claim 1, further including:

a motor operatively coupled to the trigger mechanism;

an air generator coupled to the motor and directing air towards the rings; and a gear system coupled to the motor and applying pressure to the tubing to cause bubble solution to be delivered from the reservoir to the rings.

3. The assembly of claim 2, wherein actuation of the trigger mechanism simultaneously causes (i) the air generator to direct air towards the rings, (ii) the gear system to deliver bubble solution from the reservoir to the rings, and (iii) the rings to move from the first position to the second position.

4. The assembly of claim 1, wherein release of the trigger will cause the curved bar to move from the second position to the first position across the stationary member.

5. The assembly of claim 1, further including means for drawing bubble solution from the reservoir, and to deliver the bubble solution to the rings.

6. The assembly of claim 5, wherein actuation of the trigger mechanism simultaneously causes (i) the drawing means to deliver bubble solution from the reservoir to the rings, and (ii) the curved bar to move from the first position to the second position.

7. The assembly of claim 5, wherein the drawing means includes the trigger mechanism, at least one rotating pressure roller and a guide wall, the pressure roller having a base section and an end that has a smaller diameter than the base section, with the tubing positioned between the end of the pressure roller and the guide wall when the trigger mechanism is not actuated, and with the tubing positioned between the base section of the pressure roller and the guide wall when the trigger mechanism is actuated.

8. The assembly of claim 7, wherein actuation of the trigger mechanism pushes the pressure roller against the tubing.

9. The assembly of claim 1, wherein the mouth is defined by two portions of the housing that pivot with respect to each other such that the rings are housed completely inside the housing when the two portions of the housing are pivoted to a closed position.

10. The assembly of claim 3, wherein the mouth is defined by two portions of the housing that pivot with respect to each other, and wherein actuation of the trigger mechanism also simultaneously causes the two portions of the housing to pivot away from each other.

11. The assembly of claim 1, wherein the rings experience a curved movement as the curved bar moves from the first position to the second position across the stationary member.

12. The assembly of claim 1, wherein the housing is shaped like one of the following animals: a pony, a dog, a horse, a lion, a tiger, a bear, a giraffe, an elephant, a hippopotamus, a crocodile, an alligator, a rabbit and a cat.

13. The assembly of claim 1, wherein the housing has an opening, and a portion of the reservoir is positioned adjacent the opening, with the reservoir being made of a transparent material.

14. A bubble generating assembly comprising:

a housing defining a mouth, with a curved stationary member secured to a permanent location extending across a portion of the mouth, the mouth further including an opening inside the mouth;

a reservoir provided inside the housing and retaining bubble solution, the reservoir having an interior;

a trigger mechanism;

a plurality of bubble generating rings positioned adjacent the mouth, the plurality of bubble generating rings arranged on a curved bar;

a tubing that couples the interior of the reservoir with the rings;

a link assembly that couples the trigger mechanism and the curved bar in a manner in which actuation of the trigger mechanism causes the curved bar to be moved from a first position to a second position across the stationary member; and a tube connecting the opening in the mouth to the reservoir for supplying bubble solution from the mouth to the reservoir;

wherein the housing is shaped like one of the following animals: a pony, a dog, a horse, a lion, a tiger, a bear, a giraffe, an elephant, a hippopotamus, a crocodile, an alligator, a rabbit and a cat;

wherein the curved bar and the curved stationary member curve along a common axis wherein the common axis extends vertically from the bottom of the housing to the top of the housing so that the central portion of the curved bar and the central portion of the curved stationary member extend further along a common plane in a direction from the rear of the housing to the front of the housing than the ends of the curved bar and the ends of the curved stationary member extend along said common plane in said direction from the rear of the housing to the front of the housing wherein said common plane extends horizontally from the rear of the housing to the front of the housing.

15. The assembly of claim 14, wherein the mouth is defined by two portions of the housing that pivot with respect to each other such that the rings are housed completely inside the housing when the two portions of the housing are pivoted to a closed position.

16. A bubble generating assembly comprising:

a housing shaped as an animal and defining a mouth, with a curved stationary member secured to a permanent location extending across a portion of the mouth;

a reservoir provided inside the housing and retaining bubble solution, the reservoir having an interior;

a trigger mechanism;

a plurality of bubble generating rings positioned adjacent the mouth, the plurality of bubble generating rings arranged on a curved bar;

a tubing that couples the interior of the reservoir with the rings;

a motor operatively coupled to the trigger mechanism;

an air generator coupled to the motor and directing air towards the plurality of bubble generating rings; and a link assembly that couples the trigger mechanism and the curved bar in a manner in which actuation of the trigger mechanism causes the curved bar to be moved from a first position to a second position across the stationary member;

wherein the curved bar and the curved stationary member curve along a common axis wherein the common axis extends vertically from the bottom of the housing to the top of the housing so that the central portion of the curved bar and the central portion of the curved stationary member extend further along a common plane in a direction from the rear of the housing to the front of the housing than the ends of the curved bar and the ends of the curved stationary member extend along said common plane in said direction from the rear of the housing to the front of the housing wherein said common plane extends horizontally from the rear of the housing to the front of the housing.

17. The assembly of claim 16, wherein the mouth is defined by two portions of the housing that pivot with respect to each other such that the plurality of bubble generating rings are housed completely inside the housing when the two portions of the housing are pivoted to a closed position.

18. The assembly of claim 16, wherein the housing is shaped like one of the following animals: a pony, a dog, a horse, a lion, a tiger, a bear, a giraffe, an elephant, a hippopotamus, a crocodile, an alligator, a rabbit and a cat.

* * * * *